United States Patent [19]

Sugiyama

[11] Patent Number: 4,669,263

[45] Date of Patent: Jun. 2, 1987

[54] HIGH-SPEED GENERATOR FOR A GAS TURBINE ENGINE

[75] Inventor: Matsuyoshi Sugiyama, Susono, Japan

[73] Assignee: Toyota Jidosha Kabushiki Kaisha, Toyota, Japan

[21] Appl. No.: 799,167

[22] Filed: Nov. 18, 1985

[30] Foreign Application Priority Data

Nov. 19, 1984 [JP] Japan ..... 59-242236

[51] Int. Cl.[4] ..... F02C 7/06; F01M 9/00

[52] U.S. Cl. ..... 60/39.08; 184/6.11

[58] Field of Search ..... 60/39.08; 184/6.11; 290/52; 415/168, 169, 110, 112; 417/366, 372

[56] References Cited

U.S. PATENT DOCUMENTS 2,791,090 5/1957 Hooker ..... 60/39.08

3,147,913 9/1964 Davies et al. ..... 184/6.11

FOREIGN PATENT DOCUMENTS 32409 3/1977 Japan ..... 60/39.08

976117 11/1982 U.S.S.R. ..... 60/39.08

OTHER PUBLICATIONS

Burgess, Neil, "Design Analysis of the General Electric TG-180 Turboset" *Aviation Week,* Jul. 14, 1947.

*Primary Examiner*—Louis J. Casaregola

*Assistant Examiner*—Timothy S. Thorpe

*Attorney, Agent, or Firm*—Cushman, Darby & Cushman

[57] ABSTRACT

In the arrangement of a high-speed generator having its rotor shaft direct-coupled to the main shaft of a gas turbine engine, the upper space of a oil tank fixed to the generator communicates to a cavity formed between the high-speed generator and the air intake of the gas turbine engine, aside from the normal oil return path; and the cavity is open to the atmosphere through the upper space of the oil tank, thereby eliminating any difference in pressure between the cavity and the inside of the high-speed generator. With elimination of any pressure differences, the development of air flow at a tiny gap between the rotor and the stator of the high-speed generator can be avoided, resulting in successful prevention of oil leakage from the rotor bearing into the tiny gap and no drop in the efficiency of the high-speed generator.

7 Claims, 3 Drawing Figures

HIGH-SPEED GENERATOR FOR A GAS TURBINE ENGINE

BACKGROUND OF THE IVENTION

1. Field of the Invention:

The present invention relates to a high-speed generator direct-coupled to a single-shaft gas turbine engine, etc.

2. Description of the Prior Art:

As illustrated in FIG. 1, a single-shaft gas turbine engine is often designed such that its main turbine shaft 1 is direct-coupled to the shaft of rotor 3 of high-speed generator 2. In such a high-speed generator 2, rotor 3 runs so fast that, when the lubricating oil invades tiny gap 5 between rotor 3 and stator 4, as very large frictional force acts between rotor 3 and stator 4 and the loss due to this force is very large. Moreover, the frictional force imposes an overload on the engine, possibly causing a sudden engine stop. Therefore, it is necessary to avoid invasion of the lubricating oil into tiny gap 5.

Usually, the lubricating oil is stored in an oil tank 6, from which it is pumped up by an oil pump 7 and supplied to various parts of high-speed generator 2, and it is returned to oil tank 6 after lubricating various parts of high-speed generator 2.

As for the oil possibly flowing into tiny gap 5 between rotor 3 and stator 4, there is considered the oil held in stator 4. The oil in stator 4 may flow into tiny gap 5 when the inner cylinder surface of stator 4 is broken. But this invasion of the oil can be prevented by fabricating the inner cylinder surface of, for instance, ceramic which is a heat-resistant material.

As for the lubricating oil for the bearings 8, 9 of rotor 3, there are provided return paths 10, 11, by which the oil which lubricates bearings 8, 9 and which moves toward rotor 3 is returned to oil tank 6, and seals 12, 13, which prevent oil invasion. It would, however, be difficult to completely prevent oil leakage toward rotor 3, no matter what type of seals 12, 13 may be employed, and the slight oil leakage would be unavoidable. This oil leakage is normally so small that the oil which has leaked can be returned to oil tank 6 via return paths 28, 29 without the invasion of the oil into tiny gap 5.

However, as will be explained with reference to FIG. 1, a problem develops when the high-speed generator is direct-coupled to a gas turbine engine.

The annular chamber 15 at the front of the compressor 14 of the gas turbine engine is subjected to negative pressure of, say, about 1500 mmAq on account of the drop in static pressure due to high-speed suction of air and on account of a pressure drop in the air passage from an air cleaner 16 just ahead of the compressor impeller. Annular chamber 15 is cut off by a seal 19 from a cavity 18 formed between air intake 17 and high-speed generator 2. But the seal 19 is not effective enough for complete cutting-off of chamber 15 from cavity 18, and as a result, the air in cavity 18 is sucked into annular chamber 15 on account of a differential pressure between them. Thus the pressure in cavity 18 gradually becomes negative.

On the other hand, the following happens with the pressure in the upper space 20 of oil tank 6. Upper space 20 of oil tank 6 is open to the atmosphere through breather 23 and oil mist separator 24. When the oil is returned to oil tank 6, from bearing 22 between compressor 14 of the engine and turbine wheel 21 of the engine, the air which has leaked into the bearing chamber of bearing 22 flows with the oil into oil tank 6. On account of the air flowing into oil tank 6, a pressure in upper space 20 of oil tank 6 becomes about +100 mmAq. In this state, the air tends to flow from space 20 into cavity 18 formed between air intake 17 and high-speed generator 2. However, return oil path 25 communicating between cavity 18 and space 20 of oil tank 6 is filled up with oil returning from bearings 9, 26. Thus it is difficult for the air to flow in path 25 from space 20 to cavity 18, and the differential pressure between cavity 18 and upper space 20 of oil tank 6 is maintained. Therefore, there also is maintained a differential pressure between cavity 18 and tiny gap 5 which communicates to upper space 20 of oil tank 6 via the path 28. As a result, the air tends to flow from tiny gap 5 into cavity 18, and at the same time the air tends to flow from the bearing 8 into tiny gap 5.

On account of this flow of air, a large volume of the oil which has passed through bearing 8, together with the air, leaks into space 27 through seal 12. A back flow of air also takes place in return path 28 on account of air leaking toward cavity 18. The oil which has gone into space 27 fails to return to oil tank 6, and, instead flows into tiny gap 5 between rotor 3 and stator 4, thereby causing the above-mentioned problem.

Accordingly, although the invasion of bearing oil, used by high-speed generator 2, into the tiny gap 5 at rotor 3 can normally be prevented by sealing, when a gas turbine engine is direct-coupled to high-speed generator 2, a differential pressure develops between the gas turbine side and the opposite side of bearing 8, causing an air flow which is liable to entrain the lubricating oil into tiny gap 5. This problem is particularly exacerbated, when the sealing provided is a noncontact type which is usually desirable with respect to mechanical loss or durability.

SUMMARY OF THE INVENTION

An object of the present invention is to eliminate the differential pressure developed between a cavity, formed by a high-speed generator and an air intake, and the inside of the high-speed generator, and to prevent the invasion of lubricating oil into a tiny gap between a rotor and a stator of the high-speed generator, thereby avoiding an efficiency drop of the high-speed generator, when the high-speed generator is direct-coupled to a gas turbine engine.

To accomplish this object, in a high-speed generator for a gas turbine engine, according to the present invention a rotor shaft of a high-speed generator is direct-coupled to a main shaft of a gas turbine engine and there is provided an oil tank for storage of the oil which lubricates various parts of the high-speed generator and the gas turbine engine. An upper space of the oil tank communicates via an external or an internal passage to a cavity, formed between the high-speed generator and an air intake of the gas turbine engine, in addition to an oil return path from various parts of the high-speed generator. Preferably the upper space of the oil tank communicates to the cavity at a higher position than the axis of the main shaft of the gas turbine.

In the high-speed generator for the gas turbine engine, the cavity formed between the high-speed generator and the air intake of the gas turbine engine communicates, aside from the normal oil return path, to the upper space of the oil tank which communicates via a breather, etc. to the atmosphere. Therefore, for instance even if the oil return path is filled up with oil, the cavity is open to the atmosphere through the upper space of the oil tank and accordingly a negative pressure does not develop in the cavity. Therefore, a pressure difference between the cavity and the inside of the high-speed generator also does not develop. Accordingly, the occurence of air flow due to a differential pressure between both sides of the bearing of the high-speed generator can be avoided, and thereby the invasion of the oil into the tiny gap between the rotor and the stator can be prevented.

BRIEF DESCRIPTION OF THE DRAWINGS

The above and other objects, features and advantages of the present invention will become apparent and more readily appreciated from the following detailed description of a present preferred exemplary embodiment of the invention taken in conjunction with the accompanying drawings, in which.

DETAILED DESCRIPTION OF PREFERED EMBODIMENTS

Figure 1:
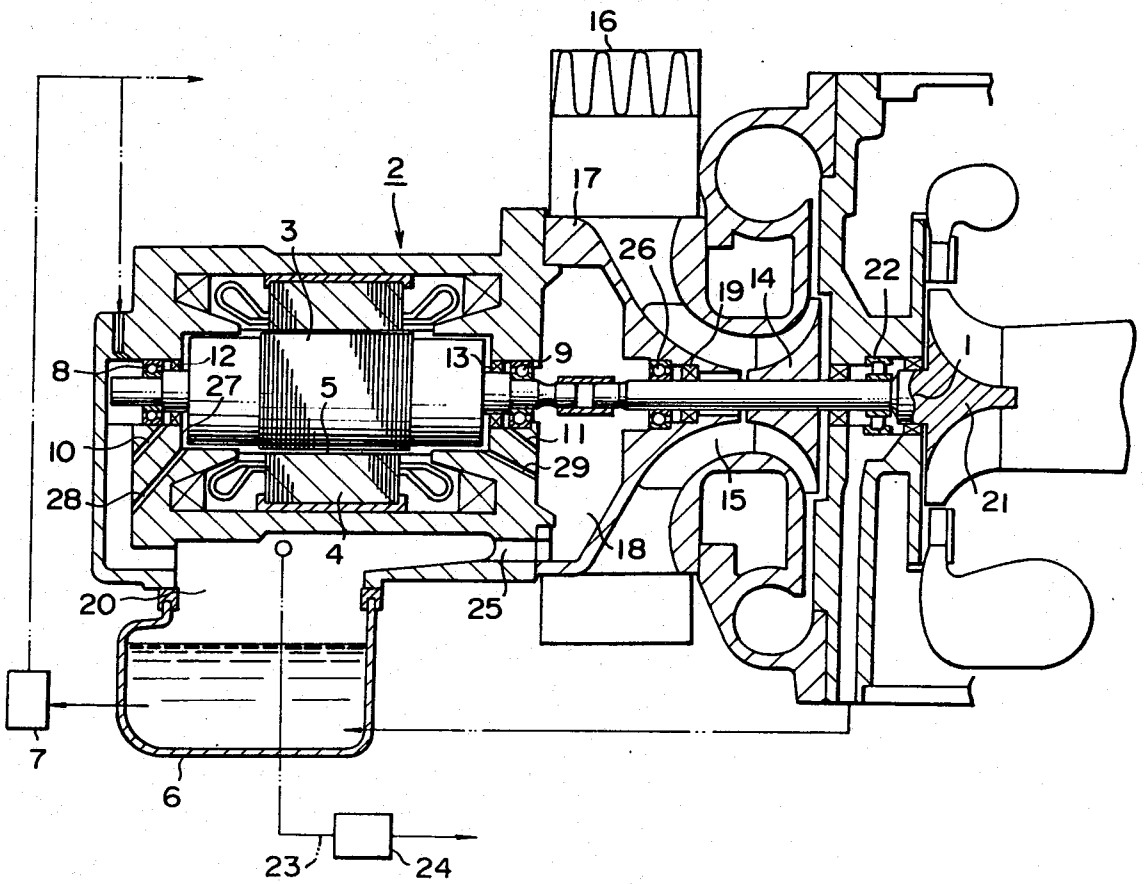
FIG. 1 PRIOR ART
FIG. 1 is a vertical sectional view of a conventional high-speed generator for a gas turbine engine.
Figure 2:
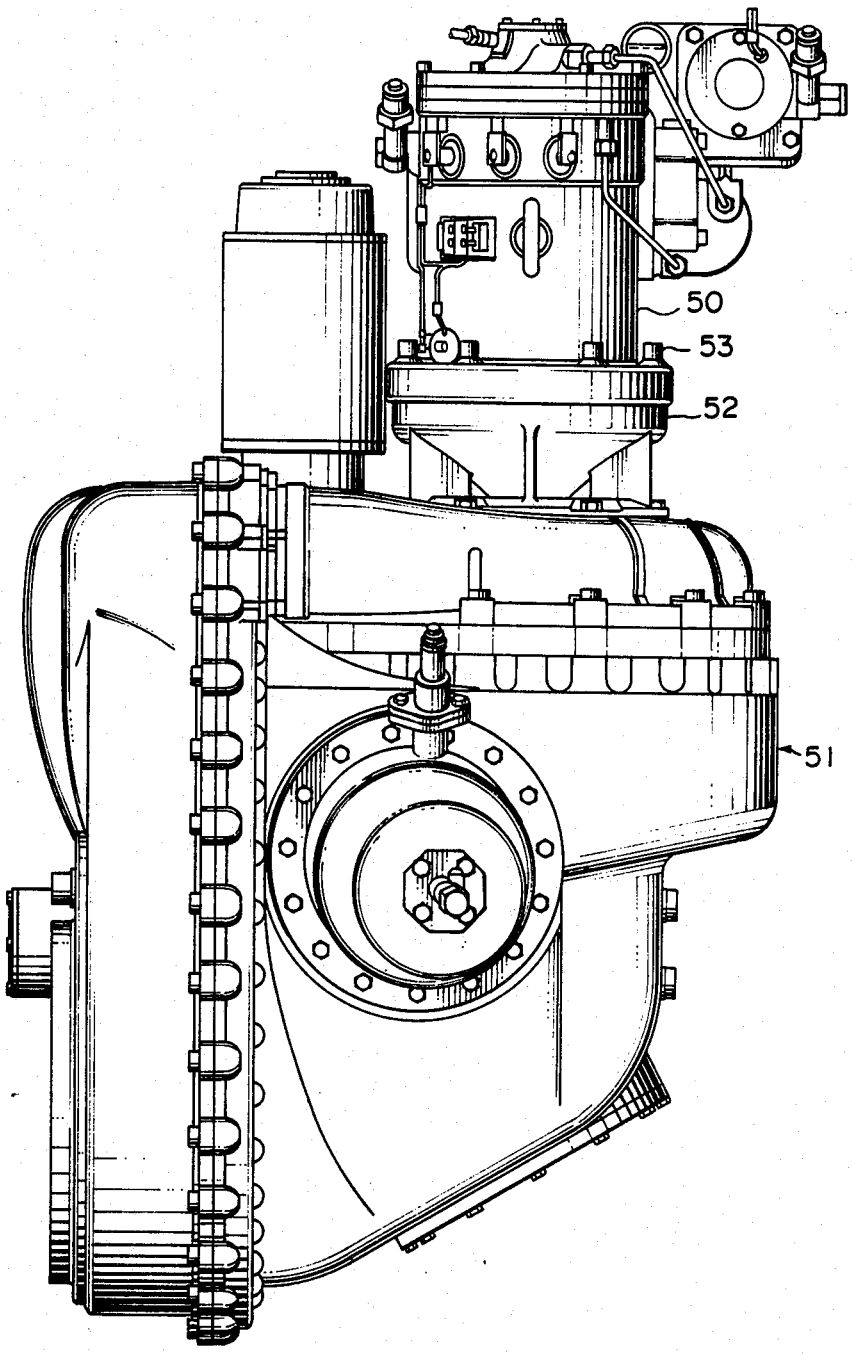
FIG. 2 is a profile view of the present invention.
Figure 3:
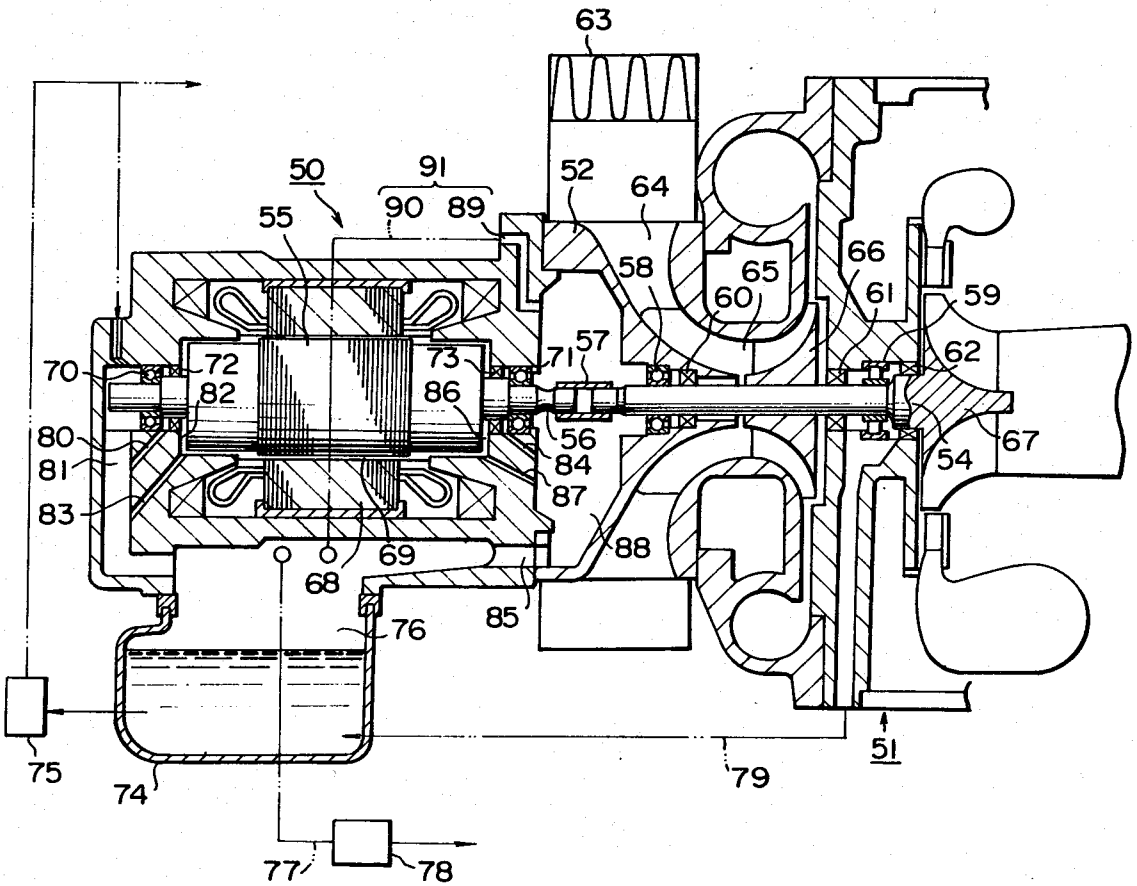
FIG. 3 is a vertical sectional view of a high-speed generator for a gas turbine engine according to one embodiment of the present invention.

FIGS. 2 and 3 show a high-speed generator for a gas turbine engine according to one embodiment of the present invention. In these figures, 50 is a high-speed generator, which is fixed by bolts 53 to an air intake 52 of a single-shaft gas turbine engine 51.

As seen in FIG. 3, a shaft 56 of a rotor 55 of high-speed generator 50 is direct-coupled to a main shaft 54 of gas turbine engine 51 by means of a coupling 57. Main shaft 54 is rotatably supported by bearings 58, 59, and in the bearing areas there are provided seals 60, 61, 62. Air is sucked in through an air cleaner 63 and it goes from a suction port 64 via an annular chamber 65 into compressor 66. Refernce numeral 67 denotes a turbine wheel.

On the periphery of rotor 55 of high-speed generator 50, stator 68 is installed. A tiny gap 69 is formed between rotor 55 and stator 68. Both ends of rotor 68 are rotatably supported by bearings 70, 71. On the rotor side of bearings 70, 71, there are provided non-contact seals 72, 73.

At the base of high-speed generator 50, there is installed an oil tank 74 to store the lubricating oil. The oil in tank 74 is pressure-fed by oil pump 75 to various parts (bearings, etc.) in high-speed generator 50 and further to the bearings in gas turbine engine 51; and the oil after use is returned to tank 74. The upper part of oil tank 74 has a vacant space 76, which is open to the atmosphere through a breather 77 and an air filter 78. Meanwhile, the lower part of oil tank 74 communicates via an oil return path 79 to bearing 59 of main shaft 54 of gas turbine engine 51.

In the vicinity of the bearings of rotor 55, the space between bearing 70 and seal 72 communicates via oil return path 80 to oil return path 81 of oil tank 74, while the space 82 between seal 72 and rotor 55 communicates via oil return path 83 to oil return path 81. At the bearing position on the opposite side, the space between bearing 71 and seal 73 communicates via oil return path 84 to oil return path 85 of oil tank 74, while the space 86 between seal 73 and rotor 55 communicates via an oil return path 87 to oil return path 85.

Between air intake 52 and high-speed generator 50 to which shaft 56 of rotor 55 is direct-coupled, there is formed a cavity 88, the bottom of the cavity 88 forms a part of oil return path 85.

Cavity 88 communicates to upper space 76 of oil tank 74 via a communicating path 91 consisting of a path 89 formed in a part of high-speed generator 50 and of an external path 90 constructed from a pipe. Path 89 communicates to the upper space of cavity 88, desirably communicating to the upper space at a higher position than the axis of main shaft 54 of gas turbine engine 51.

In this embodiment, external path 90 constructed of a pipe is employed as a means to communicate between cavity 88 and upper space 76 of oil tank 74, but instead of external path 90, an internal path (not shown) formed within the device may be employed for the same purpose.

The following is a description of the function performed by the high-speed generator for the gas turbine constituted as described above.

The lubricating oil is pressure-fed from oil pump 75 to bearing 70, 71 at both ends of rotor 55. This pressure-fed oil lubricates bearings 70, 71 and thereafter it also flows to the side of rotor 55. Since oil leakage cannot completely be prevented by seals 72, 73 (particularly this is difficult in the case of non-contact sealing), a slight amount of oil unavoidably invades spaces 82, 86.

On the other hand, under the effect of the negative pressure in annular chamber 65 as aforementioned, the cavity 88, formed between high-speed generator 50 and air intake 52, is liable to develop a negative pressure. If a negative pressure develops in cavity 88, since the pressure in upper space 76 of oil tank 74 may turn slightly positive, on account of the air flowing into upper space 76 from oil return path 79 as aforementioned, it would become difficult for the oil to flow in oil return path 85. As a result, the oil would fill return path 85, and negative pressure would be maintained in cavity 88. Thus a differential pressure would exist between cavity 88 and tiny gap 69. The sealing effect of bearings 71, 70 and seals 73, 72 cannot be perfect, and accordingly air flow would occur from space 82 into tiny gap 69, whereby the oil could be entrained within the air flow.

According to the present invention, the top portion of cavity 88 communicates to upper space 76 of oil tank 74, namely the communication takes place through the communicating path 91, which is outside of oil return path 85 and accordingly free from the possibility of being filled with oil. Thus cavity 88 can remain open to the atmosphere through the communicating path 91 and upper space 76 of oil tank 74 and no negative pressure develops in cavity 88. As a result with no differential pressure developed between cavity 88 and the inside of high-speed generator 50, there can be no occurrence of air flow due to a differential pressure, and thus the oil can be prevented from invading to tiny gap 69.

According to the present invention, therefore, even in the case of a high-speed generator direct-coupled to a gas turbine engine, the oil can be prevented successfully from invading the tiny gap between the rotor and the stator, whereby frictional loss due to an oil inflow or a failure of engine operation can be avoided with no drop in the efficiency of the high-speed generator.

It should be noted in particular that, since oil invasion into the tiny gap can be avoided even with use of a non-contact seal at the rotor shaft, the merits of the non-contact seal, i.e., no friction and high durability can be fully utilized to produce a high-speed generator characterized by little loss and high efficiency.

Although only a preferred embodiment of the present invention has been described in detail, it will be appreciated by those skilled in the art that various modifications and alterations can be made to the particular embodiment shown without materially departing from the novel teachings and advantages of the invention. Accordingly, it is to be understood that all such modifications and alterations are included within the scope of the invention as defined by the following claims.

What is claimed is:

1. A high-speed generator for a gas turbine engine, said high-speed generator comprising:

a generator having a rotor shaft direct-coupled to a main shaft of said gas turbine engine, said generator defining a tiny gap between a rotor and a stator thereof;

an oil tank storing oil for lubricating various parts of said generator and said gas turbine engine;

oil return path means for returning oil from said various parts of said generator and said gas turbine engine to said oil tank; and communicating path means for communicating from a cavity formed between said generator and an air intake of said gas turbine engine to an upper space in said oil tank, said communicating path means being separate and distinct from said oil return path means, communication due to said communicating path being capable of eliminating any difference in pressure between said cavity and said tiny gap.

2. The high-speed generator of claim 1, wherein said communicating means communicates to said cavity at a higher position than the axis of said main shaft of said gas turbine engine.

3. The high-speed generator of claim 1, wherein said communicating means comprises a pipe located externally of said high-speed generator.

4. The high-speed generator of claim 1, wherein said communicating means comprises an internal path formed with the device.

5. The high-speed generator of claim 1, wherein said oil return means comprises at least one return path communicating from bearings at both ends of the rotor shaft to said oil tank.

6. The high-speed generator of claim 1, wherein said oil tank communicates to said oil return means for returning oil from bearings supporting said main shaft of said gas turbine engine.

7. The high-speed generator of claim 1, wherein said upper space of said oil tank is open to the atmosphere through a breather.

* * * * *